US005154344A

United States Patent [19]

Loch

[11] Patent Number: 5,154,344

[45] Date of Patent: Oct. 13, 1992

[54] MULTIPLE PART BUSINESS FORM AND RELATED PROCESS

[76] Inventor: Mark Loch, 4171 Reliance St., Whitehall, Pa. 18052

[21] Appl. No.: 780,201

[22] Filed: Oct. 22, 1991

[51] Int. Cl.[5] ..... B65D 27/06

[52] U.S. Cl. ..... 229/304; 229/301; 229/303

[58] Field of Search ..... 229/69, 70, 300, 301, 229/303, 304, 305, 314, 316

[56] References Cited

U.S. PATENT DOCUMENTS

| | | | |
|---|---|---|---|
| 3,104,799 | 9/1963 | Steidinger | 229/69 |
| 3,437,259 | 4/1969 | Stiedinger | 229/305 X |
| 3,837,565 | 9/1974 | Johnsen | 229/314 X |
| 3,981,435 | 9/1976 | Johnsen | 229/314 X |
| 4,002,290 | 1/1977 | Van Malderghem | 229/314 X |
| 4,055,294 | 10/1977 | Traise | 229/304 X |
| 4,095,695 | 6/1978 | Steidinger . | |
| 4,239,114 | 12/1980 | Denay . | |
| 4,343,430 | 8/1982 | Martineau | 229/314 X |
| 4,380,315 | 4/1983 | Steidinger | 229/314 X |
| 4,384,670 | 5/1983 | Dicker | 229/305 X |
| 4,435,001 | 3/1984 | Mills et al. | 229/301 X |
| 4,632,427 | 12/1986 | Angus . | |
| 4,705,298 | 11/1987 | Van Malderghem et al. | 229/301 X |
| 4,706,877 | 11/1987 | Jenkins . | |
| 4,744,508 | 5/1988 | Fowler et al. | 229/301 |
| 4,756,468 | 7/1988 | Jenkins . | |
| 4,779,792 | 10/1988 | Lombardo . | |
| 4,809,906 | 3/1989 | Lombardo . | |
| 4,813,593 | 3/1989 | Pennock | 229/69 |
| 4,824,142 | 4/1989 | Dossche . | |
| 4,840,306 | 6/1989 | Lombardo . | |

*Primary Examiner*—Stephen Marcus
*Assistant Examiner*—Jes F. Pascua
*Attorney, Agent, or Firm*—Nixon & Vanderhye

[57] ABSTRACT

A business form (and related process) includes a web folded medially to form two plies secured one to another about their marginal edges with a third ply secured about three of its four edges to one of the first and second plies forming a return envelope. The edges of the third ply are offset inwardly relative to the edges of the first and second plies. A fourth insert ply is adhesively secured between the first and third plies along only two of its transverse and longitudinal edges. The two edges are substantially aligned with two of the edges of the second ply, leaving two other edges of the fourth ply inwardly offset from the remaining edges of the second ply.

17 Claims, 4 Drawing Sheets

MULTIPLE PART BUSINESS FORM AND RELATED PROCESS

BACKGROUND AND SUMMARY OF THE INVENTION

The present invention relates to a combined multi-part business form incorporating a return envelope, and to a related process for making such a form. More specifically, the invention relates to the arrangement of the intermediate plies, i.e., return envelope and insert plies, of the form relative to the carrier web or outer plies, i.e., the outgoing envelope.

Combined multi-part business forms, or return mailer assemblies, are generally known in the art. It has been the customary practice, however, to adhere the intermediate webs or plies along all of their marginal edges in corresponding registry with the carrier web. An addressee, upon receipt, removes the marginal tear strips and opens the business form. The return mailer assembly usually includes an integral return envelope formed by adjacent plies which are secured one to the other along three margins. One of the margins is usually left unsealed to form a pocket, and a flap is provided on one of the plies along the open end of the pocket which may be folded over and adhesively secured to the other ply to seal the return envelope.

Inserts which are removed from such assemblies typically have remnants on all four sides, resulting from the separation of the insert from the margins of the form. These remnants make the one or more inserts difficult to process subsequently through various readers or scanners.

Those prior art forms which have all webs joined along all four peripheral edges can also reduce form integrity since, occasionally during mailing, an edge becomes unsealed due to the bulkiness of the margins and the relative weakness of the adhesive used. In addition, when opening such a form, the webs do not always easily separate into individual plies as is intended by the manufacturer. Oftentimes, the recipient is forced to physically separate the webs, one from another, along the margins, which can lead to unwanted tearing of the form and, possibly even to its destruction In the manufacture of such prior art forms, the combined form (having all webs in alignment with one another) is subject to increased tenting problems while traveling through the automated assembling and folding areas. Typically, the outer panels of the form are folded over a larger radius than that of the inner plies with the result that misregistration often occurs. In addition, when attempting to align the various plies along the margins of the outer panels, misregistration of the tractor feed holes may also occur, thereby necessitating a reduction in the speed of the traveling webs so as to insure proper alignment.

The present invention provides a multi-part business form in the configuration of a return mailer assembly and related process which minimizes or eliminates the foregoing and other disadvantages of prior multi-part business forms. Thus, the invention provides a novel and improved form with an integral return envelope and one or more inserts specifically designed to reduce tenting and other difficulties subsequently encountered during reading or scanning of an insert which has perforation remnants thereon.

According to an exemplary embodiment of the invention, there is provided a business form constructed from multiple plies of sheet material, e.g., paper, which may be adhesively secured one to the other along selected margins to enclose in one exemplary embodiment, a return envelope formed integrally with the form and an insert (or inserts) in unique registration with the form. More specifically, the return mailer assembly of this invention includes first and second outer plies which form the outgoing envelope, and a return envelope formed in part by a third return envelope ply secured along three of its margins to one of the first and second outer plies. An unsealed fourth margin of the third intermediate ply is provided with a return envelope flap and an adhesive for sealing engagement with the outer ply when the return envelope is ready for mailing. A fourth insert ply is generally aligned with, and adhesively secured along only two corresponding margins of the second outer ply. The remaining two margins of the fourth insert ply are unsecured, and are defined by smooth, die cut edges.

In the preferred embodiment of the invention, the outer plies are formed from a single sheet of paper folded substantially medially. Tear strips are provided along the remaining three margins of the form such that, upon their removal, the outer plies may be unfolded, thereby exposing the insert and return envelope for use. Since, the fourth insert ply is secured to only two marginal portions, upon removal of the tear strips, the fourth insert ply is free of the remainder of the assembly.

In accordance with a broader aspect of the invention, therefore, a return mailer assembly is provided which comprises first and second outer plies forming an outgoing envelope, the first and second plies secured directly to each other only along one transverse marginal edge and one longitudinal marginal edge; a third ply overlying the second ply and secured thereto along three marginal edges of the third ply to thereby form a return envelope with the second ply; and a fourth insert ply between the first and third plies, the fourth ply secured directly to the second ply along another transverse marginal edge and another longitudinal marginal edge of the second ply.

In another aspect, a return mailer assembly is provided which comprises an outgoing envelope including first and second outer plies formed from a single sheet separated from a longitudinally extending continuous web, the single sheet having a centrally located longitudinal fold line such that the outgoing envelope has upper and lower transverse edges and a pair of opposite, longitudinal side edges, one of the side edges corresponding to the fold line; a return envelope formed by a third ply and the second outer ply, the third ply having upper and lower transverse edges and longitudinal side edges, all of which are inset from corresponding edges of the first and second outer plies; and a fourth insert ply having upper and lower transverse edges and longitudinal side edges, one only of the upper and lower transverse edges and one only of the longitudinal side edges being registered with and adhered to corresponding edge portions of the first and second outer plies.

The present invention also provides a method of manufacturing a business form comprising the steps of:

(a) advancing an elongated web along a predetermined path, the web comprising first and second longitudinally divided plies, the plies having longitudinally and transversely extending margins;

(b) applying first adhesive lines along three sides of the second panel and providing a third ply in registry with the adhesive lines to thereby form a return envelope comprising the second and third plies; and (c) applying second adhesive lines along two sides of the second ply, outside the first adhesive lines and providing a fourth ply in registry with the second adhesive lines to thereby form a removable insert.

After shipment to the customer and printing according to the customer's requirements, the form may be made ready for mailing by folding the first ply over the second ply, and adhesively securing the first ply to the second and fourth plies.

Other objects and advantages of the invention will become apparent from the detailed description which follows.

DETAILED DESCRIPTION OF THE DRAWINGS

Figure 1:
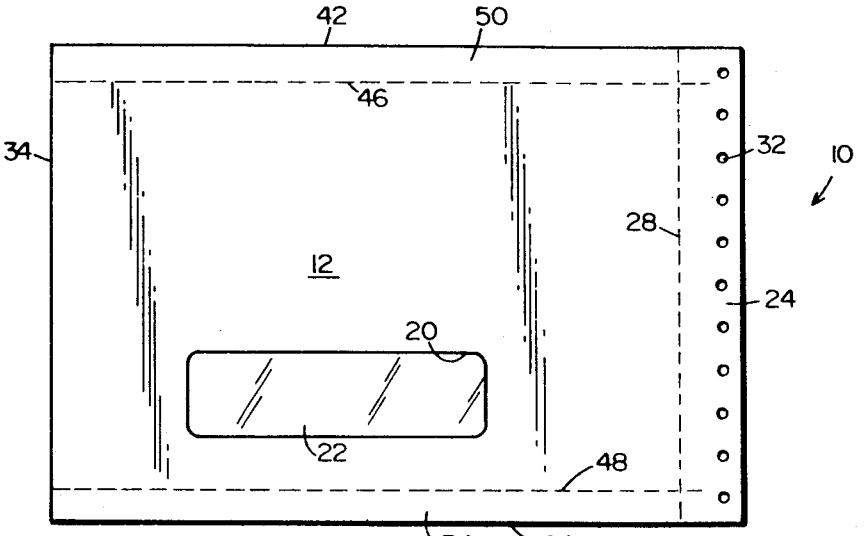
FIG. 1 is a front view of the return mailer assembly in accordance with the invention.
Figure 2:
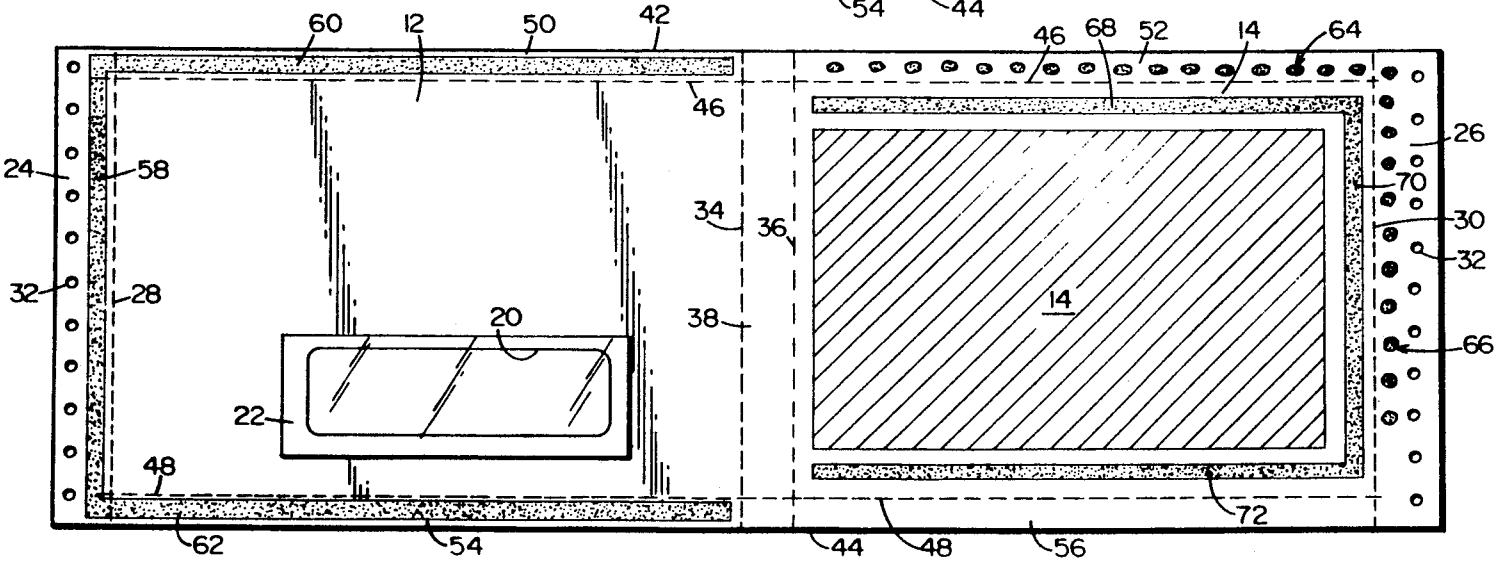
FIG. 2 is a front view of the return mailer assembly of FIG. 1, with the front sheet peeled back and the insert and return envelope ply removed.
Figure 3:
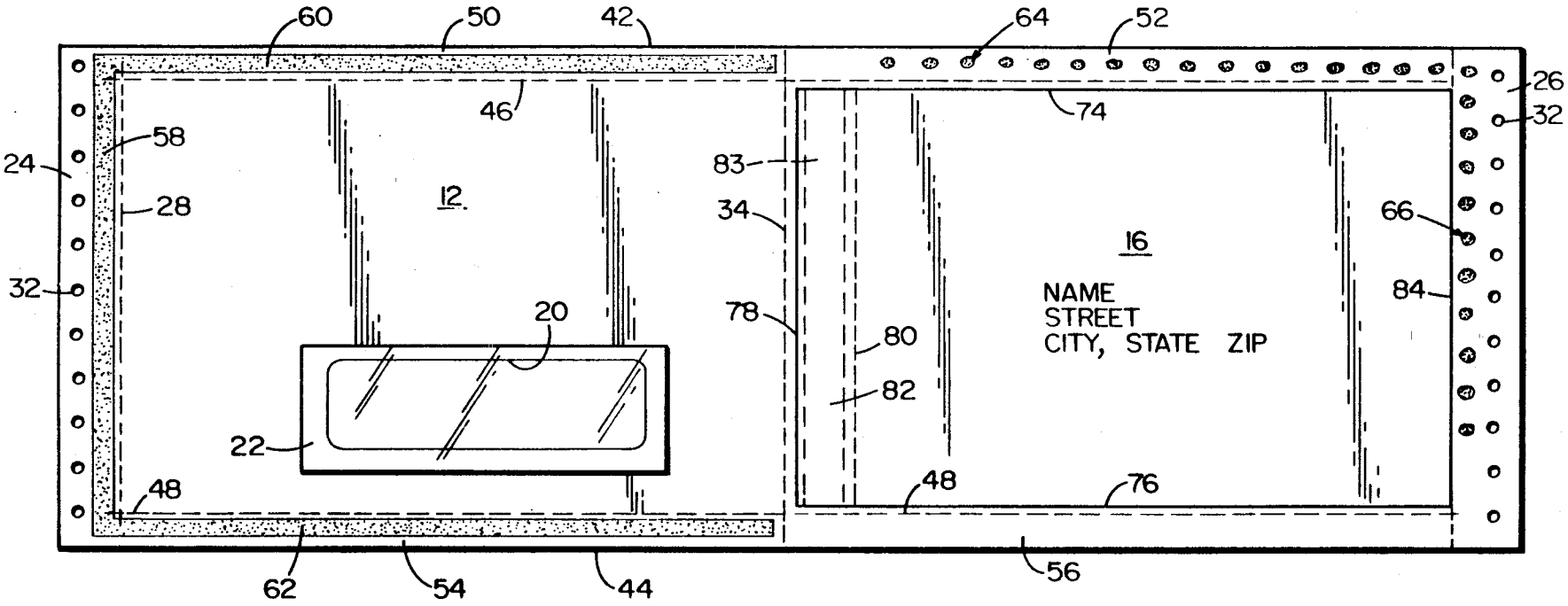
FIG. 3 is a front view of the return mailer assembly of FIG. 2 with the insert removed but with the return envelope ply in place.

Referring now to FIGS. 1-3, there is illustrated a return mailer assembly, generally designated 10, constructed in accordance with one exemplary embodiment of the invention, and which includes a first outer ply 12, a second outer ply 14, and a pair of intermediate plies including a third return envelope ply 16 and a fourth insert ply 18. In this return mailer assembly, the first and second outer plies 12 and 14 form a first outgoing envelope, while the return envelope ply 16 and second outer ply 14 combine to form a second return envelope. The insert ply 18 comprises an insert to be removed and returned by the recipient, but could also comprise a remittance document, all or part of which is to be returned in the return envelope.

The first outer ply 12 (the outgoing envelope or cover sheet) is comprised of paper or other conventional stock, and is provided with a die cut window portion 20 which may be covered by a transparent sheet 22 or the like, so as to display the name and address of the addressee pre-printed on the underlying insert ply 18. Other arrangements for displaying addressee information may be employed, and this feature does not constitute part of this invention.

With specific reference to FIG. 2, the first and second outer plies 12, 14 are initially part of a continuous web, with marginal feed strips 24, 26 extending longitudinally of the web, i.e., in the direction of travel of the web during manufacture. The marginal feed strips 24, 26 are defined by longitudinally extending lines of weakness, for example, perforation lines 28, 30, and each strip is provided with a plurality of apertures 32 adapted to engage conventional tractor drive components. In one exemplary embodiment, the width of the web may be about 16 inches.

A third longitudinal perforation line 34, installed at press, is provided centrally of the web, thus providing a fold line which enables first outer ply 12 to be folded over the second outer ply 14 so as to form the outgoing envelope, which in this embodiment would have a width of about 8 inches.

A fourth longitudinal perforation line 36, installed at press, is located adjacent line 34, and within the second outer ply 14. This line 36 defines a removable flap 38 which facilitates use of the second outer ply as part of the return envelope, as explained in further detail below.

Upper and lower edges 42, 44 of the plies 12, 14 are initially defined in the continuous web by transversely extending lines of perforations (not shown), longitudinally spaced along the web, and defining the depth of each form. In the exemplary embodiment, each form has a depth of 5½ inches.

Additional transverse lines of weakness, or perforation lines 46, 48 are located inwardly of edges 42, 44, respectively, thereby forming removable stub portions 50, 52, 54 and 56. It will be appreciated that when folded to the configuration illustrated in FIG. 1, stub portions 50 and 52, will overlie each other along the upper edge of the mailer assembly; stub portions 54 and 56 will overlie each other along the lower edge of the mailer assembly; and marginal edge portions 24, 26 will overlie each other along one side edge of the mailer assembly, the other side edge being formed by fold line 34.

With reference again to FIG. 2, the inner surface of the first outer ply 12 is provided with adhesive strips 58, 60 and 62 (preferably a patterned heat seal adhesive) along and within the marginal feed strip 24, upper stub portion 50 and lower stub portion 54, respectively.

The inner surface of the second outer ply 14 is provided with lines 64, 66 of glue spots along and within the upper stub portion 52 and marginal feed strip 26, respectively. In addition, glue lines 68, 70 and 72 are provided on ply 14 adjacent, and inside the transverse perforation lines 46, 30 and 48, respectively.

The return envelope ply 16, best seen in FIG. 3, has upper and lower die-cut edges 74, 76 which extend parallel to, and offset slightly inwardly from transverse perforation lines 46, 48, respectively, of the second outer ply 14. In the exemplary embodiment, the ply 16 may have a depth of about 4⅞ inches. The return envelope ply extends toward center fold line 34 but terminates just short at a left hand cut edge 78. A longitudinal perforation line 80 extends parallel to edge 78, defining a foldable flap 82 having pressure sensitive adhesive on its underside (not shown), with transfer tape (shown in phantom at 83) applied over the adhesive. It will be appreciated that a rewettable adhesive may be utilized in place of the pressure sensitive adhesive. The foldable flap 82 substantially overlies the removable flap 38. The right hand side of the return envelope ply terminates at a cut edge 84 lying along the underlying longitudinal perforation line 30 of the second outer ply 14.

The return envelope ply 16 is adhered to the second outer ply 14 by the glue lines 68, 70 and 72 to thereby define an envelope pocket open along a fourth edge defined by perforation line 36 (after removal of flap 38).

While the return envelope is shown as a side-opening envelope, it will be appreciated that it may be of the top-opening type as well.

Figure 4:
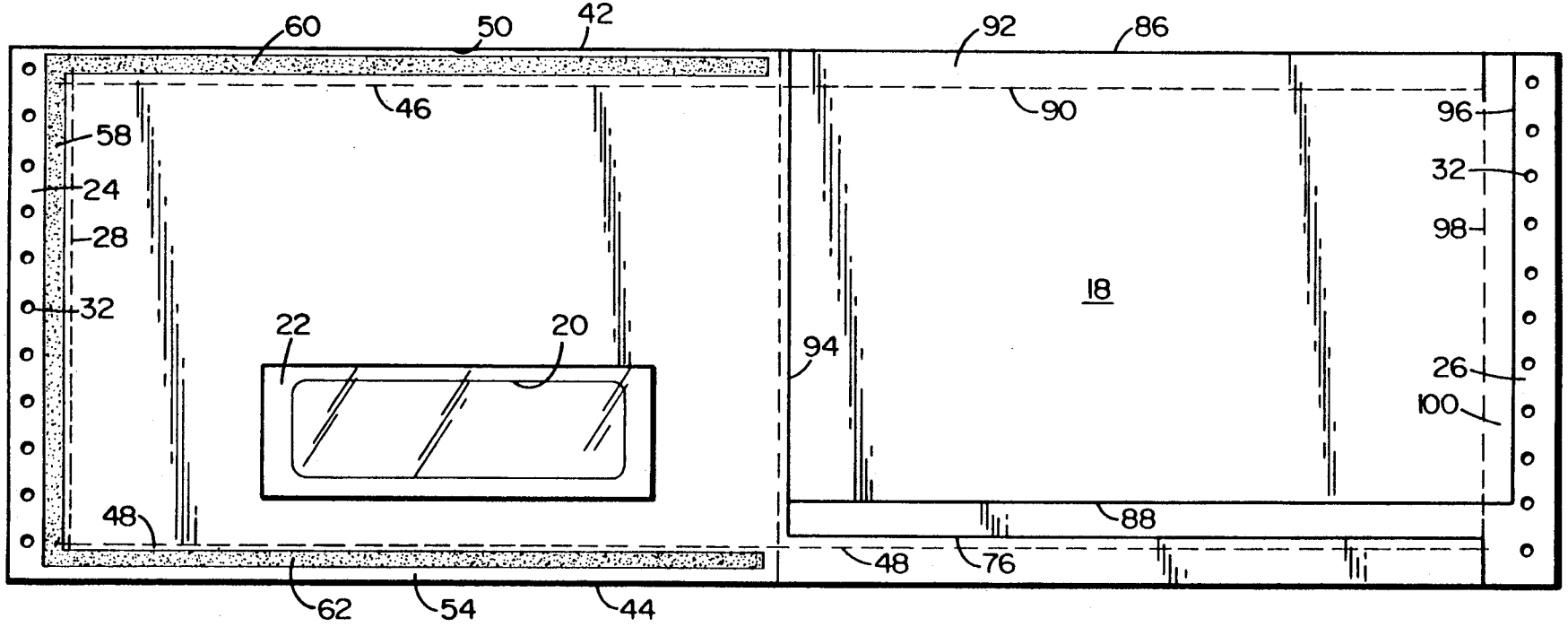
FIG. 4 is a front view of the return mailer assembly of FIG. 3 with the insert ply in place overlying the return envelope ply.

Turning now to FIG. 4, the insert ply 18 has an upper edge 86 aligned with upper edge 42 of the second outer ply 14, and a lower die-cut edge 88 spaced inwardly of both the lower edge 44 of the second outer ply 14, and the lower edge 76 of the return envelope 14. A perforation line 90 extends parallel to upper edge 86 and thus defines a marginal tear strip 92 aligned with tear strips 50, 52. On the left hand side, insert ply 18 terminates at a cut edge 94 substantially aligned with left hand edge 78 of the return envelope ply, while on the right hand side, ply 18 terminates within the marginal feed strip portion 26, between glue spots 66 and feed apertures 32. A perf line 98 lies inside the edge 96, substantially overlying perf line 30 of ply 14, defining a marginal strip 100. The fourth insert ply 18 is adhered directly to the second outer ply 14 by lines 64 and 66 of glue spots on the second outer ply 14.

Upon receipt of the return mailer assembly, the addressee is instructed to remove the right hand stub defined by overlying marginal strip portions 26, 100 and 24; the upper overlying stub portions 50, 92 and 52; and then the lower overlying stub portions 54, 56. The first outer ply 12 may then be folded outwardly about fold line 34 to an open position and thereafter separated from ply 14 by tearing along the fold line 34.

The separated ply 12, in one exemplary embodiment, may be filled out and inserted within the return envelope. The fourth insert ply 18 is now free of any connection to the remainder of the assembly following the removal of the stub portions across the upper and right side edges of the assembly, and in an exemplary embodiment, the ply may be retained by the addressee as a record, or as a document to be used at some later date. Alternatively, separated ply 12 may be retained by the customer as a record or receipt, and insert ply 18 returned in the return envelope.

The removable flap 38 may then be separated from return envelope ply 14 and discarded. After insertion of ply 12 (or insert ply 18) in the return envelope, the transfer tape 83 may be pulled away from the return envelope flap adhesive, and the flap 82 folded about fold line 80 and sealed to the ply 14. The return envelope is then ready for mailing.

By reason of the unique arrangement of the above described assembly, the insert ply 18 is subject to remnants only along the perforation lines 90, 98. The remaining edges 88, 96 are smooth cut edges which reduce the likelihood of difficulties in subsequent reading/scanning of the insert. At the same time, the free edges along two sides of the fourth insert ply reduce the likelihood of tenting during assembly of the form.

Figure 5A:
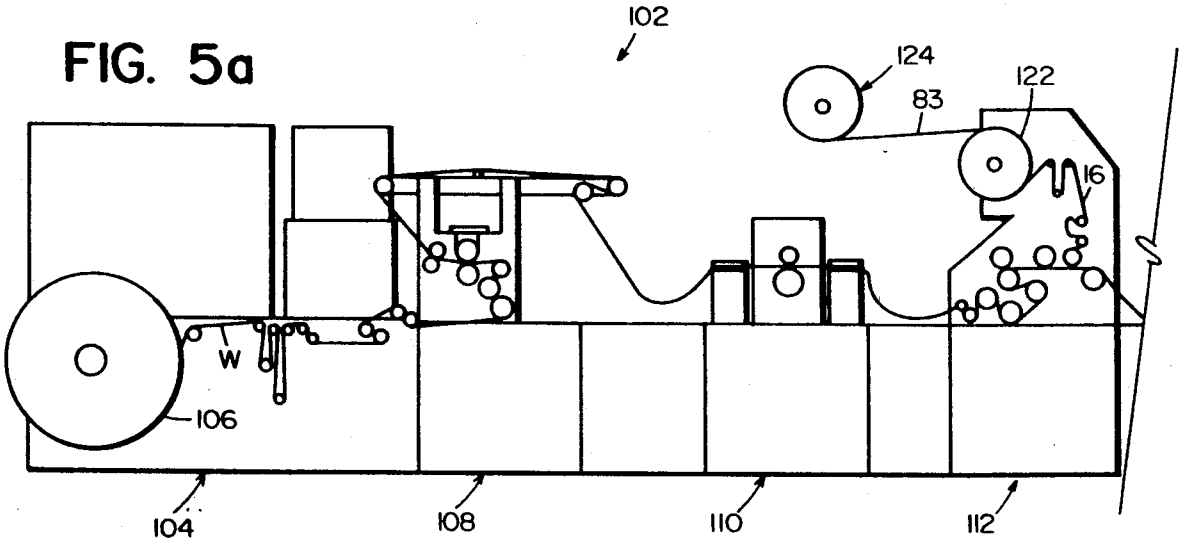
FIGS. 5*a* and 5*b* are schematic side elevational views of the apparatus employed in the manufacture of the return mailer assembly shown in FIGS. 1-4.
Figure 5B:
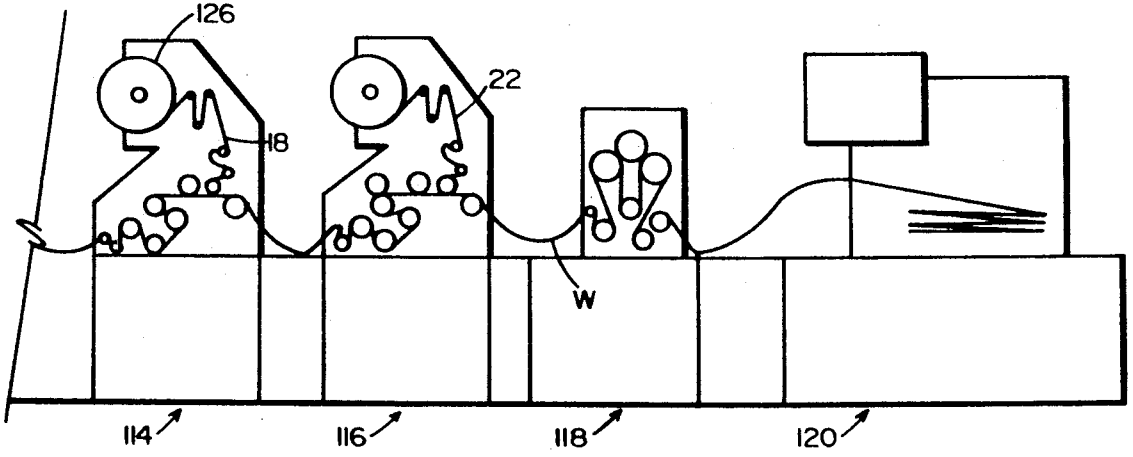

Referring now to FIG. 5, apparatus 102 used to construct the return mailer assembly of this invention is shown in schematic form. The apparatus comprises a supply module 104 including a printed roll or roll of product 106 for supplying first and second outer plies 12, 14 as a continuous web W via a conventional tractor drive mechanism. The continuous web is fed from supply module 104 to a hot melt glue (or pressure seal glue) module 108, a die cut window module 110, a pair of cold glue modules 112 and 114, a window patch module 116, a perforation module 118, and a folder/perforation module 120.

More specifically, continuous elongated web W, comprising the first and second plies 12 and 14, travels in a predetermined, substantially linear path through the various modular units of the apparatus, the modular units per se being of conventional construction, but newly arranged in accordance with the invention. Lines of patterned heat activated adhesive 58, 60 and 62 are applied by the first glue module 108 to the first ply 12. The web W then passes through module 110 wherein window 20 is die cut in ply 12 of web W. Next, the web W is processed through the first cold glue module 112 where lines of adhesive 68, 70 and 72 (defining the return envelope pocket) are applied to the second ply 14.

The return envelope ply 16 is supplied from the supply spindle 122 and is cut off at $4\frac{2}{3}$ inch intervals. Each ply 16 is then placed in registry with lines of adhesive 68, 70 and 72 on the second ply 14 forming the return envelope. In the exemplary embodiment, ply 16 is placed 1/16 inch inside the fold line 34 and marginal perforation line 30. Transfer tape 83 is supplied from the drum 124 and applied to the ply 16 as it unwinds from spindle 122.

The web W and ply 16 then passes through a second cold glue module 114 where lines of adhesive 64, 66 are applied. The fourth insert ply 18, cut off every $4\frac{2}{3}$ inches, is fed to the web W from a supply unit 126 and is placed in registry with the lines of adhesive 64, 66 of the outer ply 14 while overlying the return envelope ply 16. In the exemplary embodiment, ply 18 is positioned 1/16 inch from fold line 34 and 7/16 inch from the lower edge 76 of the return envelope ply 16. Edge 96 is aligned between holes 32 and glue spots 66. Ply 18 is also substantially aligned with the upper edge of ply 14.

The combined web W, ply 16 and ply 18 then passes through the window patch unit 116 where the transparent patch 22 is applied over the die cut window 20 of the first ply 12. Following application of the patch material 22, the web W travels to the perforator module 118 where vertical perf lines 28 and 98 and horizontal per lines 48 and 90 are applied. The form assemblies then pass through a folding module 120 where the transverse perforation lines, corresponding to edges 42, 44 are added, and the form assemblies then folded in pad form. The forms assemblies remain in continuous form, and are Z or S folded for convenient shipment. Upon receipt of the forms, the customer prints on the forms and seals them closed for mailing.

The following advantages result from the above described mailer form construction and method of manufacture.

1) The return mailer assembly is able to be manufactured in a single pass of the respective plies through the various modules.

2) The construction reduces tenting.

3) A clean edge is provided along side and bottom edges of the insert ply to thereby improve processing through readers, scanners or other electronic apparatus.

4) Better sealing is achieved in all margins.

5) Easier opening of the sealed insert document is provided by reason of the fewer plies at the edge of the form.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A return mailer assembly comprising:

an outgoing envelope including first and second outer plies formed from a single sheet separated from a longitudinally extending continuous web, said single sheet having a centrally located longitudinal fold line such that said outgoing envelope has upper and lower transverse edges and a pair of opposite, longitudinal side edges, one of said side edges corresponding to said fold line;

a return envelope formed by a third ply and said second outer ply, said third ply having upper and lower transverse edges and longitudinal side edges, all of which are inset from corresponding edges of said first and second outer plies; and a fourth insert ply having upper and lower transverse edges and longitudinal side edges, one only of said upper and lower transverse edges and one only of said longitudinal side edges being substantially registered with and adhered to corresponding edges of said first and second outer plies.

2. The return mailer assembly of claim 1 wherein said first and second outer plies have removable stub portions extending along said upper and lower transverse edges and along a side edge opposite said one of said side edges.

3. The return mailer assembly of claim 2 wherein said fourth insert ply has a first removable stub portion in alignment with the removable stub portion of the first and second plies extending along said side edge opposite said one of said side edges.

4. The return mailer assembly of claim 3 wherein said fourth insert ply has a second removable stub portion in alignment with the removable stub portion of the first and second plies extending along said upper transverse edges.

5. The return mailer assembly of claim 4 wherein, upon separation of said first and second removable stub portions from said assembly, said fourth insert ply is free of said assembly.

6. The return mailer assembly of claim 1 wherein said lower transverse edges of said third and fourth plies are offset from each other and from said lower transverse edges of said first and second plies.

7. The return mailer assembly of claim 1 wherein said first and second plies are directly connected along only one of said upper and lower transverse edges and longitudinal side edges.

8. The return mailer assembly of claim 7 wherein said only one edge is said lower transverse edge.

9. The return mailer assembly of claim 1 wherein said third return envelope ply is not attached at any point to said fourth insert ply.

10. The return mailer assembly of claim 1 wherein said first outer ply comprises a separable remittance document adapted to insertion within said return envelope.

11. A return mailer construction comprising:

first and second outer plies having longitudinally and transversely extending margins and respective marginal edges in substantial registry with one another;

a third return envelope ply between said first and second plies and having two transversely extending margins and respective marginal edges and two longitudinally extending margins and respective marginal edges, said transversely and longitudinally extending marginal edges of said third envelope ply being inset relative to said longitudinally and transversely extending marginal edges of said first and second outer plies;

a fourth insert ply between said first and third plies and having a first transversely extending margin secured between and registered with corresponding transversely extending margins of said first and second plies, and a second longitudinally extending margin secured between and in registry with corresponding longitudinally extending margins of said first and second plies wherein a third transversely extending margin and a fourth longitudinally extending margin of said fourth insert ply are unsecured;

means for releasably securing said registered margins of said second and fourth plies one to the other;

said first, second plies having lines of weakness extending along said margins in both longitudinal and transverse directions and said fourth ply having lines of weakness extending along said first transversely extending margin and said second longitudinally extending margin whereby said margins are separable from said return mailer.

12. The return mailer construction of claim 11 and further including means for securing three margins of said third ply to said first ply to define a return envelope.

13. The return mailer according to claim 11 wherein said first and second plies comprise a single sheet of material folded about a fold line such that said first and second plies lie in register one with the other.

14. The return mailer according to claim 13 wherein an open edge defining a pocket of said return envelope lies adjacent said fold line.

15. A return mailer assembly comprising first and second outer plies forming an outgoing envelope, said first and second plies each having a pair of transverse marginal edges and a pair of longitudinal marginal edges, said first and second plies secured directly to each other only along one of said pair of transverse marginal edges and one of said pair of longitudinal marginal edges; a third ply overlying said second ply and secured thereto along three marginal edges of said third ply to thereby form a return envelope with said second ply; and a fourth insert ply between said first and third plies, said fourth ply secured directly to said second ply along the other of said pair of transverse marginal edges and the other of said pair of longitudinal marginal edges of said second ply.

16. The return mailer assembly of claim 15 wherein said fourth insert ply has one free transverse marginal edge and one free longitudinal edge which remain at all times unsecured within said assembly.

17. The return mailer assembly of claim 16 wherein said first and second plies comprise a single sheet folded longitudinally about a center fold line.

* * * * *

UNITED STATES PATENT AND TRADEMARK OFFICE

CERTIFICATE OF CORRECTION

PATENT NO. : 5,154,344

DATED : October 13, 1992

INVENTOR(S) : Loch

It is certified that error appears in the above-identified patent and that said Letters Patent is hereby corrected as shown below:

On the Title page, under the inventor's information, insert --item [73] Assignee: Moore Business Forms, Inc.

Signed and Sealed this

First Day of February, 1994

*Attest:*

Bruce Lehman

BRUCE LEHMAN

*Attesting Officer*

*Commissioner of Patents and Trademarks*